US006648293B1

(12) United States Patent
Sachnoff

(10) Patent No.: US 6,648,293 B1
(45) Date of Patent: Nov. 18, 2003

(54) FOLDABLE DISPLAY CONTAINER AND METHOD FOR ASSEMBLING THE SAME

(75) Inventor: Lee E. Sachnoff, Lake Bluff, IL (US)

(73) Assignee: Braeside Plastics Corporation, Antioch, IL (US)

( * ) Notice: Subject to any disclaimer, the term of this patent is extended or adjusted under 35 U.S.C. 154(b) by 0 days.

(21) Appl. No.: 10/037,152

(22) Filed: Dec. 20, 2001

(51) Int. Cl.[7] ..... G09F 1/00

(52) U.S. Cl. ..... 248/460; 248/465; 40/124.16

(58) Field of Search ..... 248/459, 454, 248/455, 456, 460, 465; 211/42, 43; 40/124.16

(56) References Cited

U.S. PATENT DOCUMENTS

| | | | | | |
|---|---|---|---|---|---|
| 289,799 | A | * | 12/1883 | Barnes | 248/459 |
| 2,219,091 | A | * | 10/1940 | Henderson | 248/452 |
| 2,472,166 | A | * | 6/1949 | Mathewson | 40/124.16 |
| 3,718,308 | A | * | 2/1973 | Hainault | 248/460 |
| 4,066,171 | A | * | 1/1978 | Fowlie | 211/69.1 |
| D249,532 | S | * | 9/1978 | Cudahy et al. | D19/35 |
| 4,295,571 | A | | 10/1981 | Meyer | |
| D262,764 | S | | 1/1982 | Meyer | |
| D265,743 | S | | 8/1982 | Meyer et al. | |
| D286,600 | S | | 11/1986 | Meyer et al. | |
| D289,122 | S | | 4/1987 | Meyer et al. | |
| 4,674,724 | A | * | 6/1987 | Gaudet | 248/459 |
| D301,101 | S | | 5/1989 | Meyer | |
| D308,148 | S | | 5/1990 | Meyer | |
| 4,943,024 | A | | 7/1990 | Meyer | |
| 5,002,249 | A | | 3/1991 | Meyer | |
| 5,056,748 | A | | 10/1991 | Meyer | |
| 5,083,663 | A | | 1/1992 | Conway et al. | |
| D327,095 | S | | 6/1992 | Meyer | |
| 5,165,649 | A | * | 11/1992 | Neumann et al. | 248/459 |
| 5,290,002 | A | * | 3/1994 | Cohen | 248/456 |
| 5,305,875 | A | | 4/1994 | Meyer | |
| 5,344,004 | A | | 9/1994 | Meyer | |
| 5,458,242 | A | * | 10/1995 | Baka et al. | 206/488 |
| 5,607,135 | A | * | 3/1997 | Yamada | 248/456 |
| D380,496 | S | | 7/1997 | Meyer | |
| D381,362 | S | | 7/1997 | Meyer | |
| D387,384 | S | | 12/1997 | Meyer | |

* cited by examiner

*Primary Examiner*—Leslie A. Braun
*Assistant Examiner*—Jon Szumny
(74) *Attorney, Agent, or Firm*—Bell, Boyd & Lloyd LLC

(57) ABSTRACT

A foldable display container for displaying printed materials. The display container includes a base panel, a front panel hingedly connected to the base panel, a support member integrally formed with and flexibly connected to the front panel, and a connecting device integrally formed with the support member where the connecting device connects the support member to the base panel. The foldable display container is molded into a integral, flat piece that is easily packaged in single units or in bulk to reduce shipping costs. The front panel folds towards the base panel and then the support member folds away from the front panel and over the base panel. The support member is attached to the base member using the connecting device. Once connected, the base panel of the foldable display container is placed on any substantially flat surface to display printed materials and other articles.

5 Claims, 3 Drawing Sheets

FOLDABLE DISPLAY CONTAINER AND METHOD FOR ASSEMBLING THE SAME

BACKGROUND OF THE INVENTION

The present invention relates generally to display stands and boxes and more particularly, to a foldable display container that may be shipped flat and easily assembled by a consumer, retailer or other user of the display.

Foldable display containers are used to display printed materials and other articles. The display containers are formed from a single, integrated piece of plastic or other material. Each integrated piece may be packaged and shipped flat so that one or several hundred containers may be shipped at one time while minimizing shipping costs. Furthermore, the expense related to packaging materials needed to protect the containers from damage during shipping is also reduced significantly. Once the containers reach a retailer, the retailer can construct the display containers from the flat pieces by folding out and connecting the components of the display containers. There are several types of display containers that are used to display printed materials.

One such display container is disclosed in U.S. Pat. No. 4,943,024, issued on Jul. 24, 1990 to Meyer. This patent discloses a printed material holder that is formed from molded plastic and includes a flat panel having a molded clip that extends outward from the flat panel. The lower end of the clip is attached to and extends from the flat panel. The top end of the clip curves towards the front panel to a position that is even with the front surface of the flat panel. The clip has an inherent spring tension which enables the clip to be easily pulled forward to insert material behind the clip. The tension of the clip provides a pressure point at the top of the clip to hold materials in place inside the holder. In this configuration, the holder may be mounted to a wall or door.

In a separate configuration, a pair of side panels extend from either side of the flat panel. The side panels, along with the molded clip, keep materials from sliding out of the sides of the holder. A pair of L-shaped support legs are mounted to the flat panel to provide support for the holder. Tabs or buttons on the legs fit into corresponding holes on the flat panel to secure the legs to the flat panel. The legs extend from the flat panel down to the base of the holder. The legs form a triangular support on each side of the holder to support the holder for use on a flat surface such as a table top.

Although the material holder securely holds printed material in place, it has some practical problems and disadvantages. A portion of the molded clip extends above the planar surface of the flat panel so that two or more holders cannot be easily stacked or packaged for shipping. The molded clip prevents the holder from being a single flat piece that can be stacked to save room inside of a shipping container. Furthermore, the material holder includes separate support legs which can be broken or lost easily during shipping or handling of the holders.

Other types of display containers are molded from a single flat piece of material such as plastic to reduce parts and also reduce shipping costs. The molded containers include several panels that fold upright and connect together to form the display containers. One such display container is described in U.S. Pat. No. 5,083,663, issued on Jan. 28, 1992 to Conway et al. This patent discloses a plastic display container that may be hung on a wall or placed on a flat surface in an inclined position. The display container is manufactured in a blank or single piece of plastic to reduce shipping costs and parts. Once the display is received by a retailer or other customer, it may be folded and assembled into a display container for displaying printed materials and other similar articles. The display container includes a back panel, a bottom panel and a front panel hinged together along two fold lines. Two side panels are hinged on either side of the front panel. To assemble the display container, the front and rear panels are folded into an upright position. The side panels are folded inward to form the interior space of the container. Each side panel includes a top and bottom tab or protrusion that connects to corresponding slots on the rear panel. Once the tabs on the side panels engage the slots on the rear panel, the display container is secured together. This configuration is best adapted for hanging the display container on a wall or similar surface.

If the display container is placed on a flat surface such as a tabletop, then an easel panel is used to stabilize the container. The easel panel is integrally formed in the rear and bottom panels of the display container. Two small plastic protrusions extend between each side of the easel panel and the rear panel. The protrusions hold the easel panel in place until it needs to be used to support the display container. To separate the easel panel from the rear panel so that the easel panel may be folded back and secured in place, the small protrusions must be cut or snapped apart. A user may either cut the protrusions with a utility knife or similar device or snap the protrusions by placing force on the corresponding areas of the easel panel. Once separated, the easel panel is folded behind the rear panel. Notches located in a bottom portion of the easel panel fit into corresponding notches on the rear panel to hold the easel panel in place. The easel panel forms a triangular support for the display container to keep the container from tipping backwards and falling over. The container slants backward at a predetermined angle to enable the display materials to lean backward and remain in the container.

Another type of display container is described in U.S. Pat. No. 5,305,875 issued Apr. 26, 1994 to Meyer. This patent discloses a fold-up display container that is a single, integrally molded plastic unit having a base panel, a front panel, a rear panel, left and right side panels and support panels. The front panel, rear panel and side panels have a hinged portions that connect the panels to the base panel. The hinged portions enable the panels to be folded into position during assembly of the display container. The front panel and side panels are folded into an upright position where each side panel has a slot that engages a corresponding tab on the side edges of the front panel. After the tabs engage the slots on the side panels the front panel and two side panels are secured in an upright position. Furthermore, a pair of feet that project from the front panel extend below the front panel to elevate the front of the display container. The rear panel is folded into an upright position. Tabs on each side panel, located on the opposite sides of the slots, engage corresponding slots on the rear panel. The engagement secures the rear panel in an upright position. Two support panels formed in the rear panel have hinged portions so that the support panels may be folded outward away from the rear panel to provide stability for the display container. The feet located on the front panel raise the front of the display device such that the display device tilts towards the rear panel. The tilted nature of the display container enables display materials to lean against the rear panel and remain organized and inside the container. Three openings are located in the rear panel for hanging the display container on a wall or similar structure.

The integrally molded display containers reduce shipping costs and eliminate the possibility of losing parts associated with the displays. These displays, however, have significant problems or disadvantages. Each of these displays have multiple panels or surfaces that include several hinged portions and several connecting components. The complexity of the display containers, requires an assembler to fold the panels in a particular order and then align corresponding connecting devices to secure the panels together. Thus, retailers or other users must spend time reading the instructions and assembling each display. If several displays are needed, substantial amounts of time and effort will be expended to assemble all of the display containers. Also, although these existing display containers are initially flat, the size of the flattened piece is still relatively large so that larger shipping packages are required to ship the containers.

Therefore, there is a need for an improved foldable display container that has a relatively small unassembled form and has a minimal number of components for assembly. The smaller flattened size reduces shipping costs, and the reduction of the number of panels, hinged portions and connecting devices that form the display containers makes assembly of the display containers easier and more efficient.

SUMMARY OF THE INVENTION

The present invention is an improved display container for displaying printed material and other similar products. The display container reduces the number of components required to form each container. Also, each display container is manufactured as a compact integral piece such that smaller packages may be used to ship the containers. Therefore, the configuration of the display containers reduces shipping costs and enables users to easily and efficiently assembly the containers for display purposes.

In one embodiment, the foldable display container of the present invention is manufactured as a flat, molded individual unit including a front panel, base panel, support member and at least one connecting device. The front panel has a hinged portion that connects to a base panel. The support member is integrally formed with the front panel and has a hinged portion that enables the support member to move relative to the front panel. At least one attachment device is integrally formed with the support member and secures the support member to the base panel. The minimal number of components reduces the overall size of the display container and thereby reduces packaging costs for the container.

The display container is assembled by folding the hinged portion between the front panel and the base panel and raising the front panel to an upright position. The support member is folded behind the front panel and over the base panel. The support member has at least one protrusion or tab that engages a corresponding opening in the base member. Once the tab is secured into the opening in the base member, the assembly is complete. After assembly of the container, the front panel defines an opening so that display materials can be inserted into the container. The assembly only requires two hinged portions and one connection, which makes the assembly of the display container easier and significantly quicker than existing display containers.

In another aspect of the present invention, ridges or grooves are formed on the surface of the base member. The ridges are formed on the top surface of the base member such that the ridges face upward when the assembly of the display container is complete. The ridges help to organize and hold the printed materials in place.

In another embodiment of the present invention, the front panel of the display container includes a second opening to hold a writing device such as a pencil or pen. In some circumstances such as with contest or registration materials, individuals are required to fill-in information. In this embodiment, the front panel defines a second opening along one edge of the front panel to hold a writing device. The writing device is inserted down through the second opening in the front panel until it is supported by the base panel.

It is therefore an advantage of the present invention to provide a display container formed from a integrally molded unit that is relatively small in size.

Another advantage of the present invention is to provide a display container that has only two hinged portions and one attachment device.

A further advantage of the present invention is to provide a display container that is easy and quick to assemble.

A still further advantage of the present invention is to provide a display container that is manufactured of a durable, resilient material that minimizes the potential for breaking during assembly.

Other features and advantages of the invention will be apparent from the following detailed disclosure, taken in conjunction with the accompanying sheets of drawings, wherein like numerals refer to like parts, elements, components, steps and processes.

BRIEF DESCRIPTION OF THE FIGURES

FIG. 4 is an enlarged cross-sectional view of the attachment device included in the display container in FIG. 1 used to secure the support member to the base panel; and.

DETAILED DESCRIPTION OF THE INVENTION

The present invention relates to a foldable display container for displaying printed material and other articles. The display container is an integrally manufactured unit that is initially in a flat form for packaging and shipping purposes. Each display container includes a front panel, a base panel and a support member. The front panel includes a hinged portion that is connected to the base panel and enables the front panel to be folded into an upright position. The support member has a flexible portion that is integrally connected to the front panel and enables the support member to be folded behind the front panel and over the base panel. An attachment device integrally formed on an end of the support member enables the support member to be attached to the base member. Once the display container is assembled, the container may be placed on a flat surface such as a tabletop, to display printed material and other articles.

Figure 1:
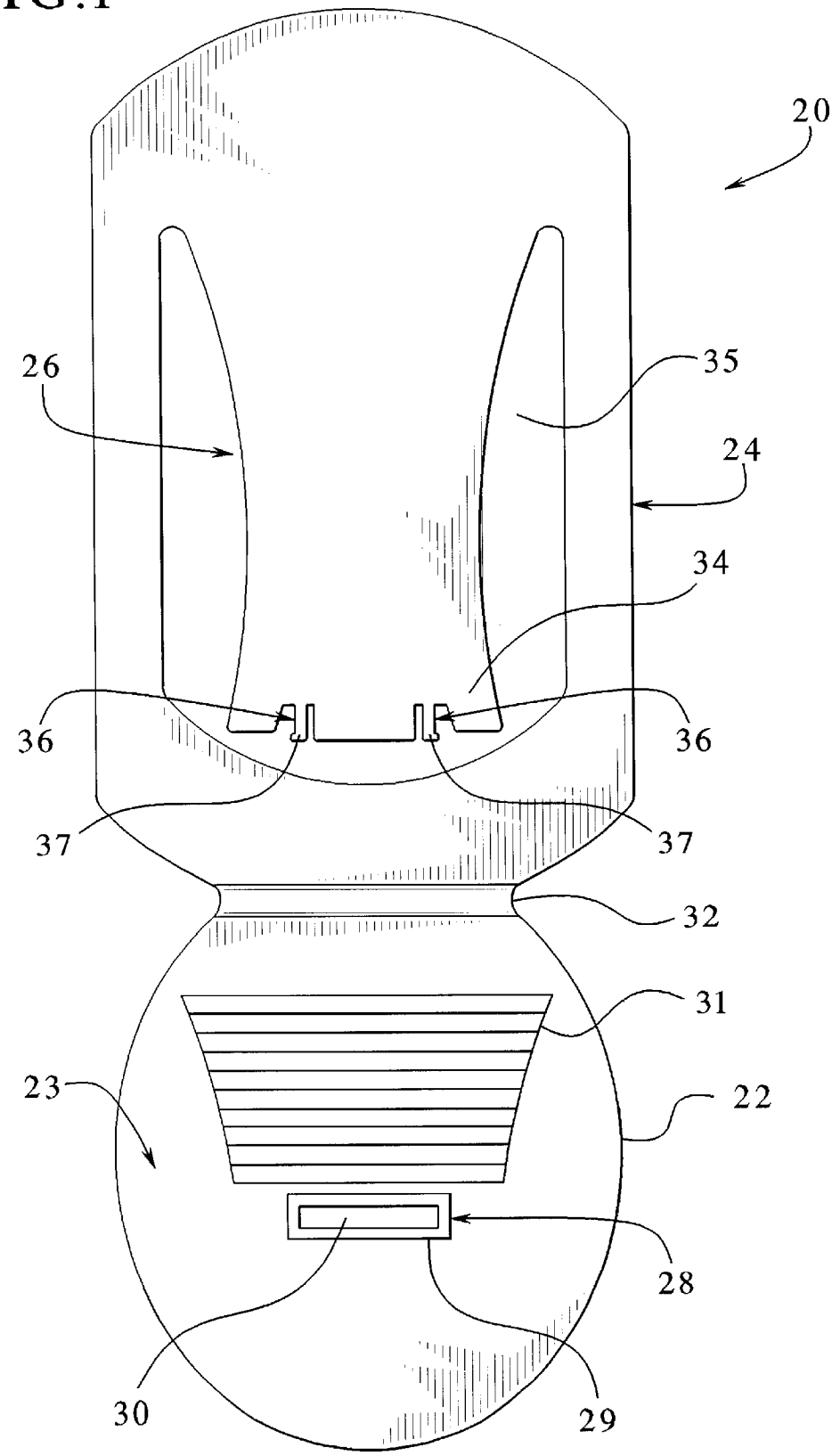
FIG. 1 is a top plan view of an embodiment of the present invention illustrating a foldable display container as initially manufactured in a flat form.

Referring to FIGS. 1 through 4, an embodiment of the present invention is illustrated where the display container 20 is shown in unassembled and assembled forms. In FIG. 1, the display container in an unassembled, flat form used for shipping. The display container 20 includes a base panel 22, a front panel 24 attached to the base panel, and a support member 26 integrally formed with the front panel. The base panel 22 preferably has a substantially circular shape that is sized so that the display container 20 is supported in an upright position when the container is placed on a flat surface. It should be appreciated that the base panel 22 can be any shape so long as the display container is stable in an upright position.

The base panel 22 includes an elongated receptacle 28, a plurality of ridges 31 and a hinged portion 32. The receptacle 28 is generally rectangular and defines an opening 30 in the base panel 22. A small wall 29 extends above the base panel 22 and borders the opening 30 in the base panel. The opening 30 receives the support member 26 during assembly of display container 20. The wall 29 adds support and rigidity to the connection of support member 26 to the base panel 22. Furthermore, a plurality of ridges 31 are integrally molded on the surface of the base panel 22. The ridges 31 position the printed material in the display container 20 and enable the display container to hold printed material in an organized and upright manner. Preferably, the ridges 31 are integrally molded on the surface of the base panel 22 such that the ridges extend slightly above the surface. However, it should be appreciated that the ridges 31 may be molded into the surface of the base panel 22 so that the ridges are more like grooves or indentations in the surface of the base panel. A hinged portion 32 is integrally molded between the base panel 22 and the front panel 24. The hinged portion 32 attaches the base panel 22 to the front panel 24 and is generally thinner or not as thick as the base panel 22, front panel 24 and support member 26. The thinner configuration of the hinged portion 32 makes the hinged portion flexible so that the front panel 24 may be moved up and down in relation to the base panel 22.

The front panel 24 has an elongated rectangular shape with rounded ends. The shape of the front panel 24, however, can be any shape as desired. On an end of the front panel 24 is hinged portion 32. As described above, the hinged portion 32 is integrally formed between one end of the front panel 24 and an end of the base panel 22. The hinged portion 32 enables the front panel to be folded either up or down. Preferably, the front panel 24 is folded up towards the top surface 23 of the base panel 22. The front panel includes a support member 26 that is integrally molded with the front panel. The support member has a flexible portion on one end so that the support member may be pulled in front of or behind the front panel 24 without causing substantial stress to the support member or the front panel. The support member 26 preferably does not have a hinged portion molded between the support member and the front panel 24. It should be appreciated, however, that a hinged portion may be molded between the support member and the front panel.

Figure 3:
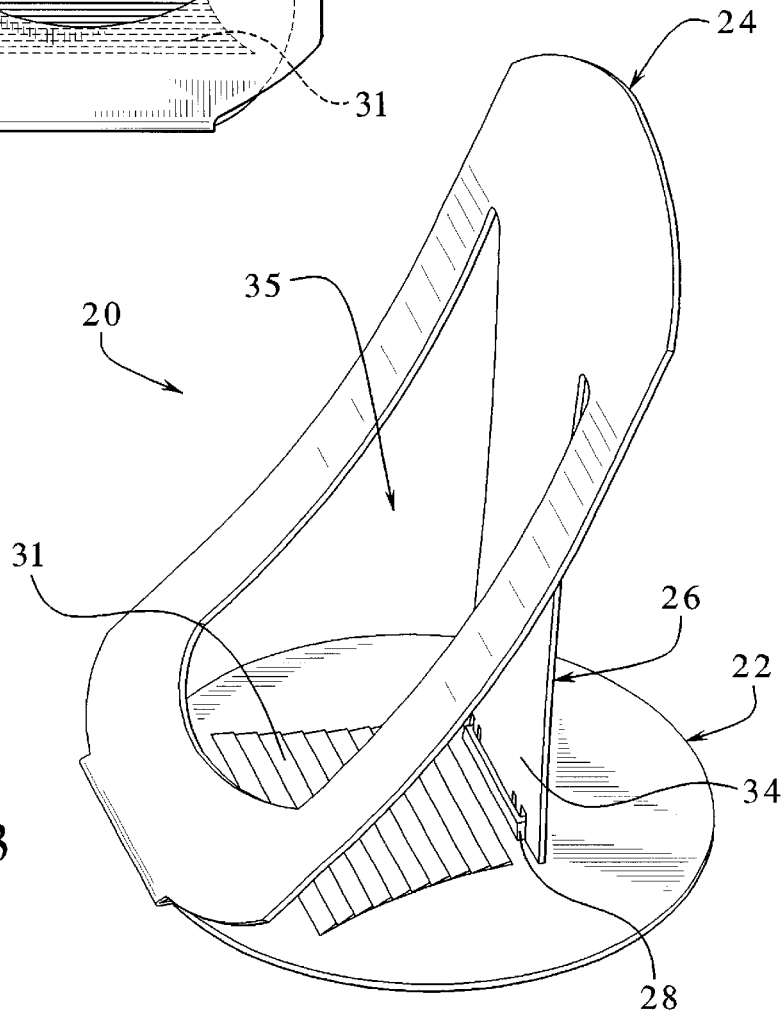
FIG. 3 is a side elevational view of the foldable display container shown in FIG. 1 in a folded form for receiving printed material.

The front panel 24 defines an opening 35 that enables the front panel to receive printed material or other similar articles. The opening 35 is able to receive printed material once the support member 26 is attached to the base member 22. Furthermore, the front panel slants backward at a predetermined angle as shown in FIG. 3, to cause the display materials to lean against the support member of the front panel and to minimize the forward and lateral movement of the materials. The angle may be any angle desired by the manufacturer.

Figure 4:
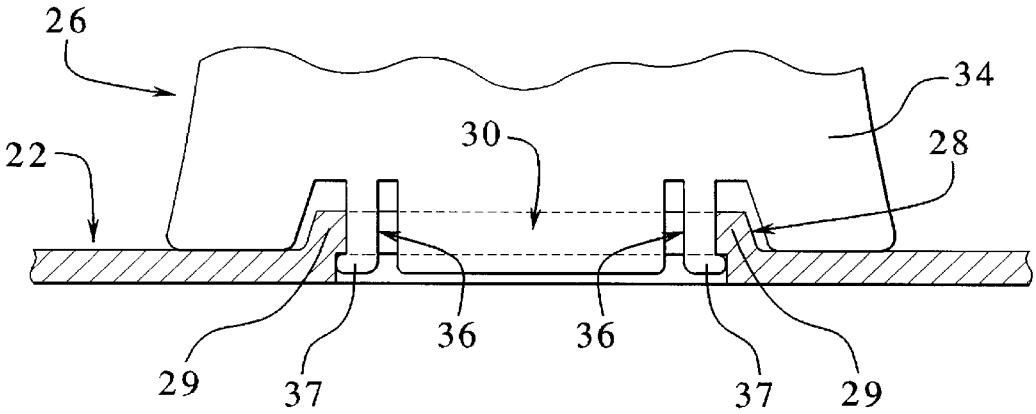

The support member 26 is an elongated piece that is integrally molded on one end to the front panel 24 and unattached on a connecting end 34. The connecting end 34 of the support member 26 attaches to the base panel 22 to secure the assembly of the display container 20. The connecting end 34 includes at least one protruding leg 36, and preferably two legs, that are spaced apart on the connecting end 34 to correspond to the width of the receptacle 28 on the base panel 22. Furthermore, the length of the legs 36 depends on the depth of the receptacle 28 on the base panel 22. The legs 36 are preferably longer than the depth of the receptacle 28 so that the lips 37 on the bottom portion of each leg 36 extend underneath the base panel 22 as shown in FIG. 4. The legs 36 are spaced so that the distance between the outer edges of legs 36 is slightly wider than the width of the receptacle opening 30. The bottoms of lips 36 are preferably rounded so the lips may be compressed inward by the receptacle wall 29 upon insertion of the legs 36 into the opening 30. The compression of the legs 36 creates a spring-like tension in the legs. As the lips 37 extend through the opening 30, the tension in the legs 36 causes the legs 36 and lips 37 to move outward. Therefore, the lips 37 extend underneath the base panel 22 to lock the support member 26 to the base panel 22 as shown in FIG. 4. As the support member is pulled out of the receptacle 28, the lips 37 are forced inward by the receptacle wall 29. Forcing the lips 37 and legs 36 inward recreates the spring-like tension in the legs. When the legs are removed from the opening 30 in receptacle 29, the legs spring back to their original position.

Figure 2:
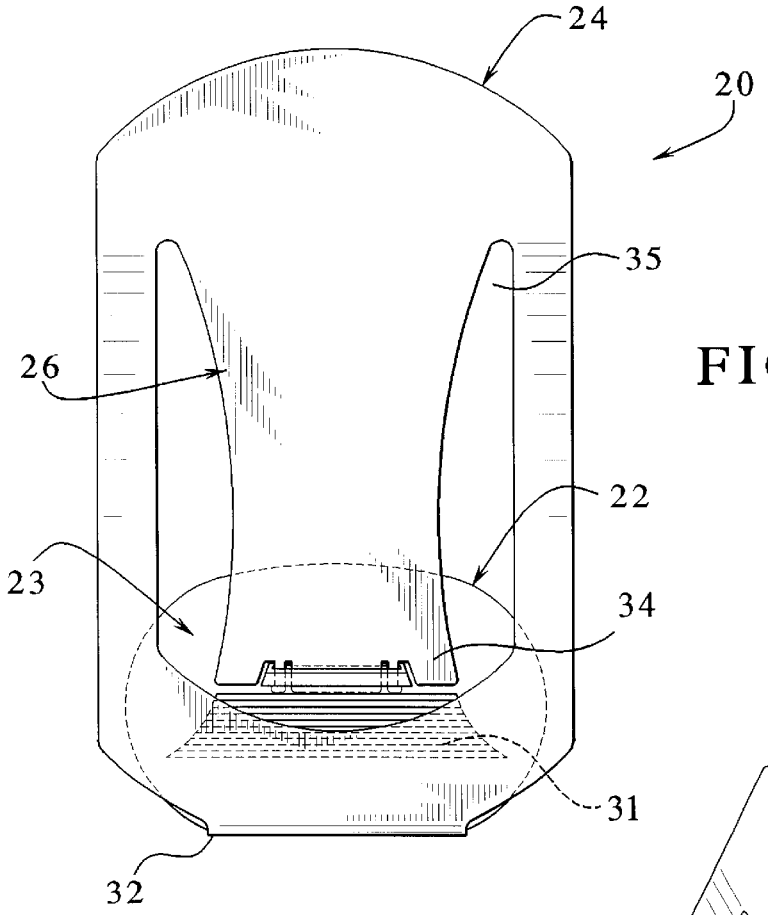
FIG. 2 is a front elevational view of the foldable display container shown in FIG. 1 in a folded form for receiving printed material.

The assembly of the display container 20 is simpler and more efficient than previous inventions. A purchaser or other user of the display container 20 receives the container in the flat form shown in FIG. 1. The flat form of the container 20 may be placed on a flat surface such as a tabletop or counter, or held in an assembler's hands. Referring to FIGS. 2 through 4, the front panel 24 folds up towards the top surface of the base panel 22 until the front panel is in a substantially upright position. While holding the base panel 22 in place, the support member 26 is bent or flexed behind the front panel 24 and over the receptacle 29 in the base panel 22. The legs 36 on the connecting end 34 of the support member 26 are inserted down through the opening 30 in the receptacle 28. When the legs 36 are pushed down through the opening 30, the lips 37 extend underneath the base panel 22 and the support member 26 is locked into position on the base panel. The display container 20 is now assembled and stable and ready to be used for displaying materials. Display materials are inserted through opening 35 defined by the front panel 24 until the materials contact the top surface of the base panel 22. The front panel 24 is positioned in a predetermined angle to cause the display materials to lean against the front panel. Furthermore, the grooves 31 formed on the base panel 22 are preferably used to organize and hold the display materials in place on the base panel. The sides of the front panel 24 maintain the lateral position of the materials. The display container 20 may be easily returned to its flat form for shipping by performing the above assembly steps in reverse order.

Figure 5:
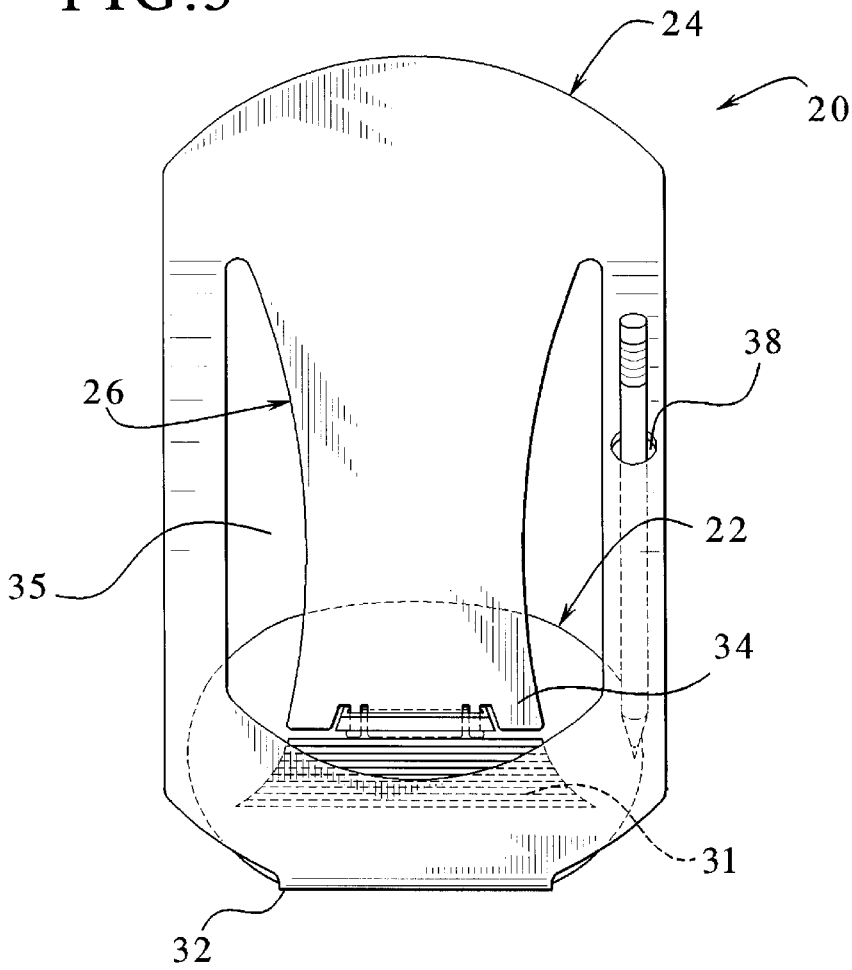
FIG. 5 is front elevational view of another embodiment of the foldable display container shown in FIG. 1 where the container includes a second opening for holding a writing device such as a pen or pencil.

Referring now to FIG. 5, another embodiment of the present invention is illustrated where the display container 20 includes a second opening 38 defined by the front panel 24 that enables a user to insert a writing device such as a pen or pencil into the front panel. A writing device may be necessary when information on the display materials must be filled out such as with contest entries or registration cards. A user may remove the pencil or pen from the display container 20, fill in the information on the display materials, and then reinsert the pencil or pen into the second opening 38.

The display container 20 is preferably manufactured with a durable material such as plastic that is flexible enough to enable a user to assemble and disassemble the display container several times without causing the display container or its components to break or substantially degrade. It should be appreciated that any type of material that exhibits the above qualities may be used to manufacture the display container 20. Furthermore, the display container 20 is preferably manufactured in several different colors and sizes to accommodate a wide variety of display options desired by retailers and other users.

While the present invention is described in connection with what is presently considered to be the preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A method for displaying materials in a foldable display container, said method comprising the steps of:

(a) molding a flat, unitary display container having a base panel, a front panel, which defines a material receiving opening, hingedly connected to the base panel and a support member flexibly connected to the front panel and adapted to removably engage the base panel;

(b) folding the front panel towards the base panel;

(c) folding the support member away from the front panel and over the base panel;

(d) securing the support member to the base panel; and (e) placing display material inside the material receiving opening defined in the front panel of the foldable display container.

2. The method of claim 1, wherein the base panel includes ridges that are integrally formed on the foldable display container for positioning the display materials in the foldable display container.

3. The method of claim 2, wherein the base panel includes grooves that are integrally formed in the base panel for positioning the display materials in the foldable display container.

4. The foldable display container of claim 1, wherein the step of securing the support member to the base panel further includes the step of extending at least one leg of the support member through a receptacle defined by the base panel to matingly engage the support member and the receptacle.

5. The foldable display container of claim 1, which includes the step of inserting at least one writing device in an item receiving opening defined by the front panel.

* * * * *